US005438307A

United States Patent [19]

Chou

[11] Patent Number: 5,438,307

[45] Date of Patent: Aug. 1, 1995

[54] SINGLE-POLE MAGNETIC REED RELAY

[75] Inventor: Tien-Ming Chou, Taichung, Taiwan

[73] Assignee: Pen-Lin Liao, Taichung, Taiwan

[21] Appl. No.: 283,186

[22] Filed: Aug. 3, 1994

[51] Int. Cl.[6] ..... H01H 1/66

[52] U.S. Cl. ..... 335/151; 335/154

[58] Field of Search ..... 335/79–86, 335/151, 152, 153, 154

[56] References Cited

U.S. PATENT DOCUMENTS

| | | | |
|---|---|---|---|
| 4,156,218 | 5/1979 | Koppensteiner | 335/153 |
| 4,177,439 | 12/1979 | Smith | 335/151 |
| 4,191,935 | 5/1980 | Archer et al. | 335/154 |
| 4,232,281 | 11/1980 | Smith | 335/151 |

*Primary Examiner*—Lincoln Donovan
*Attorney, Agent, or Firm*—Beveridge, DeGrandi, Weilacher & Young

[57] ABSTRACT

A single-pole magnetic reed relay includes a coil reel which has an axially extending reel portion, two opposite stop ends, a reed receiving groove extending axially in the reel portion and the stop ends, a reed entrance extending axially in the reel portion and the stop ends and communicated with the reed receiving groove in a radial direction, two extension portions formed outwardly of the stop ends, two first holes formed respectively and radially through the stop ends, and two second holes formed respectively and radially through the extension portions. The first and second holes are aligned axially with one another. Two coil terminals extend respectively through the first holes and have head portions positioned within the first holes. A reed contact unit is received in the reed receiving groove and has two conducting end portions which extend respectively through the second holes. A coil is wound around the reel portion and the reed contact unit and has two distal ends connected respectively and directly to the coil terminals. A case is used to contain and encapsulate the coil reel, the coil terminals, the reed contact unit and the coil by means of a resin.

2 Claims, 3 Drawing Sheets

SINGLE-POLE MAGNETIC REED RELAY

BACKGROUND OF THE INVENTION

1. Field of the Invention

This invention relates to a relay, more particularly to a single-pole magnetic reed relay which has an improved construction that utilizes a fewer number of elements and simpler steps to form the single-pole magnetic reed relay.

2. Description of the Related Art

Generally speaking, there are three different types of conventional magnetic reed relays. The first type of a magnetic reed relay is a single-pole magnetic reed relay which has a row of terminals formed on the bottom surface of a case thereof. The second type of a magnetic reed relay is a dual-pole magnetic reed relay which has two rows of terminals formed on the bottom surface of a case thereof. The third type of a magnetic reed relay is an IC magnetic reed relay which can be mounted directly on a printed circuit board.

The improvement of this invention is directed to a conventional single-pole magnetic reed relay, as shown in FIG. 1, which includes a coil reel 1, a pair of transmission terminals 2, a coil 3, a reed contact unit 4, a printed circuit board 5, a pair of coil terminals 6, and a case 7.

The coil reel 1 is formed integrally from a plastic material and includes an axially extending reel portion (1a) which has an axially extending hole (1a1) formed therethrough. A stop wall (1b) is formed on one end portion of the reel portion (1a) and has the axially extending hole (1a1) extending therethrough. A pair of extension blocks (1c) are formed on the other end portion of the reel portion (1a). The extension blocks (1c) are spaced apart from each other to confine a radially extending groove (1c1) therebetween. The radially extending groove (1c1) is communicated with the axially extending hole (1a1) of the reel portion (1a). Each of the extension blocks (1c) has a radially extending hole (1c2) formed therethrough.

The transmission terminals 2 extend respectively through the radially extending holes (1c2) of the extension blocks (1c) and have head portions (2a) positioned respectively on the top surfaces of the extension blocks (1c), as shown in FIG. 2.

The coil 3 is wound around the reel portion (1a) and has two end portions (3a) connected respectively and electrically to the head portions (2a) of the transmission terminals 2.

The reed contact unit 4, as shown in FIG. 1, can extend through the axially extending hole (1a1) of the reel portion (1a) and has an insulated tube (4a), which is disposed within the axially extending hole (1a1), and two conducting end portions (4b, 4c) which extend from two ends of the insulated tube (4a) respectively through the stop wall (1b) and through the radially extending groove (1c1).

The printed circuit board 5 supports the coil reel 1 thereon (see FIG. 2) and has two first holes (5a) formed therethrough and aligned respectively with the radially extending holes (1c2) of the extension blocks (1c) for allowing the transmission terminals 2 to extend therethrough. The transmission terminals 2 are welded within the first holes (5a), while the rest of the transmission terminals 2 which protrude outwardly of the printed circuit board 5 are cut off. The printed circuit board 5 further has two second holes (5b) formed therethrough at two end portions thereof for allowing the conducting end portion (4b, 4c) of the reed contact unit 4 to extend therethrough, and two third holes (5c) formed therethrough and located between the second holes (5b). The second and third holes (5b, 5c) are aligned with and are spaced apart from one another at equal distances. The printed circuit board 5 further has conducting elements (not shown), such as a copper coating, formed thereon and extending from each of the second holes (5b) to a respective one of the third holes (5c).

Each of the coil terminals 6 has a positioning portion (6a) welded within a respective one of the third holes (5c) of the printed circuit board 5. The coil terminals 6 and the conducting end portions (4c, 4b) of the reed contact unit 4 are therefore aligned with one another to constitute the first type of single-pole magnetic reed relay, as shown in FIG. 2. Owing to the presence of the transmission terminals 2 and the conducting elements on the printed circuit board, the coil 3 can be connected electrically and indirectly to the coil terminals 6.

The case 7 is used to contain the coil reel 1, the transmission terminals 2, the coil 3, the reed contact unit 4, the printed circuit board 5, and the coil terminals 6. Then, a resin is provided in the case 7 to encapsulate the coil reed 1, the transmission terminals 2, the coil 3, the reed contact unit 4, the printed circuit board 5, and the coil terminals 6 in the case 7 while allowing only sections of the conducting end portions (4b, 4c) of the reed contact unit 4 and the coil terminals 6 to extend outwardly of the case 7. Finally, the sections of the conducting end portions (4b, 4c) of the reed contact unit 4 and the coil terminals 6 are trimmed so as to be equal in length, thereby forming the conventional single-pole magnetic reed relay.

Because of the indirect electrical connection between the coil 3 and the coil terminals 6 via the transmission terminals 2 and the conducting elements on the printed circuit board, the conventional single-pole magnetic reed relay has to be tested after manufacture to ensure whether or not there is electrical connection between the coil 3 and the coil terminals 6. In addition, because the conventional single-pole magnetic reed relay requires a considerable number of parts as described above, it is not easy to combine these parts to constitute the conventional single-pole magnetic reed relay. Owing to the complicated combination of the parts of the conventional single-pole magnetic reed relay, the conventional single-pole magnetic reed relay has a relatively high manufacturing cost.

SUMMARY OF THIS INVENTION

Therefore, the main objective of this invention is to provide a single-pole magnetic reed relay which has an improved construction that utilizes a fewer number of elements and simpler steps to form the single-pole magnetic reed relay in order to decrease the manufacturing cost of the latter.

According to this invention, a single-pole magnetic reed relay includes a coil reel, two coil terminals, a reed contact unit, a coil and a case.

The coil reel includes an axially extending reel portion, two opposite stop ends, a reed receiving groove extending axially in the reel portion and the stop ends, and a reed entrance extending axially in the reel portion and the stop ends. The reed entrance is communicated with the reed receiving groove in a radial direction. The coil reel further includes two extension portions formed outwardly of the stop ends, two first holes formed respectively and radially through the stop ends, and two second holes formed respectively and radially through the extension portions. The first and second holes are aligned axially with one another.

The coil terminals extend respectively through the first holes and have head portions which are positioned within the first holes.

The reed contact unit is received in the reed receiving groove and has two conducting end portions which extend respectively through the second holes of the coil reel.

The coil is wound around the reel portion and the reed contact unit and has two distal ends connected respectively and directly to the coil terminals.

The case is used to contain the coil reel, the coil terminals, the reed contact unit and the coil. A resin is provided in the case to encapsulate the coil reel, the coil terminals, the reed contact unit and the coil in the case.

BRIEF DESCRIPTION OF THE DRAWINGS

Other features and advantages of this invention will become apparent in the following detailed description of a preferred embodiment of this invention, with reference to the accompanying drawings, which.

DETAILED DESCRIPTION OF THE PREFERRED EMBODIMENT

Figure 1:
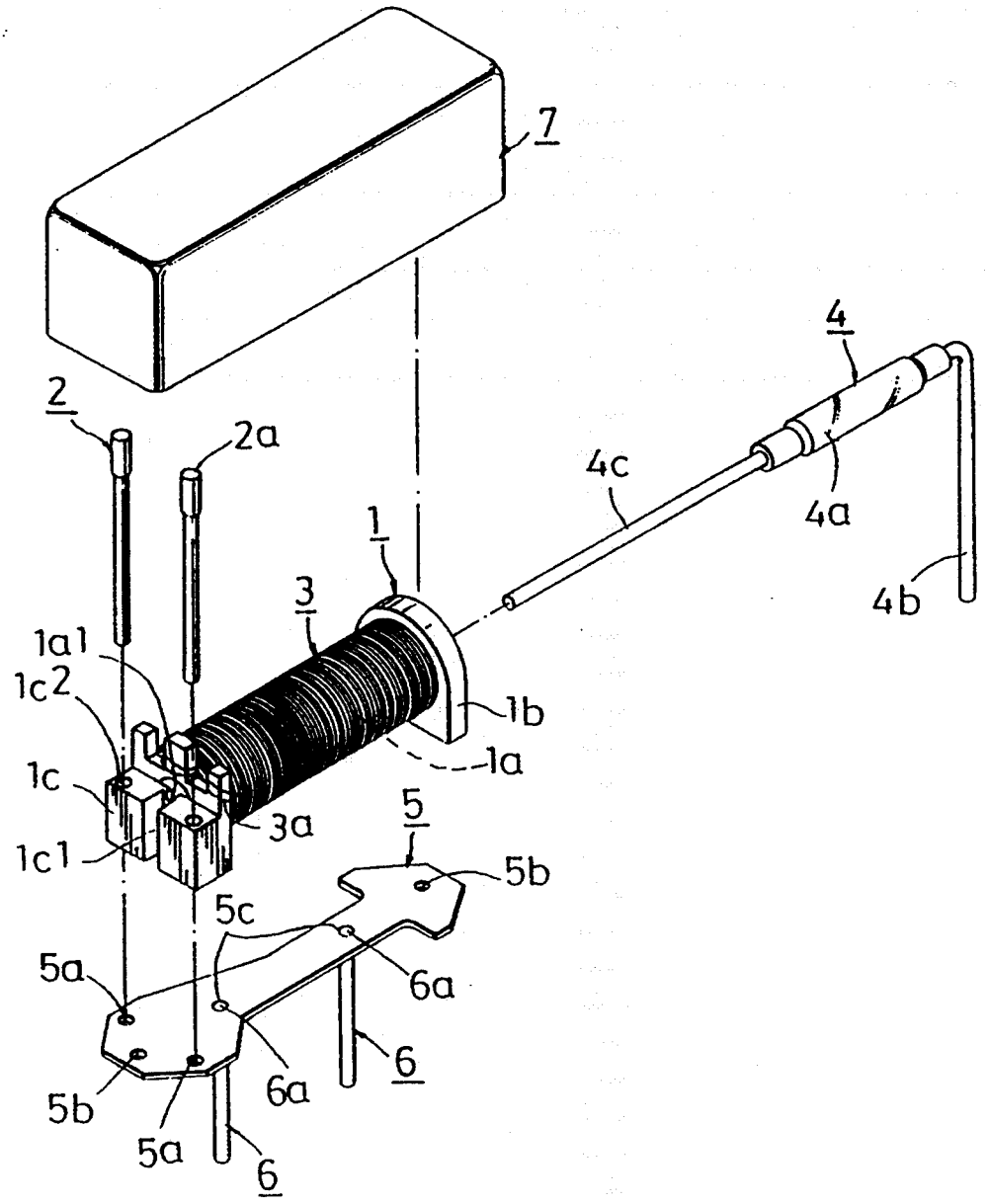
FIG. 1 PRIOR ART
FIG. 1 is an exploded view of a conventional single-pole magnetic reed relay.
Figure 2:
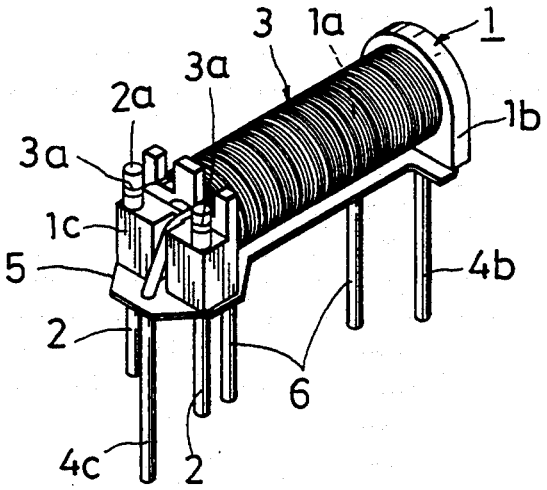
FIG. 2 is a perspective view showing the conventional single-pole magnetic reed relay.
Figure 3:
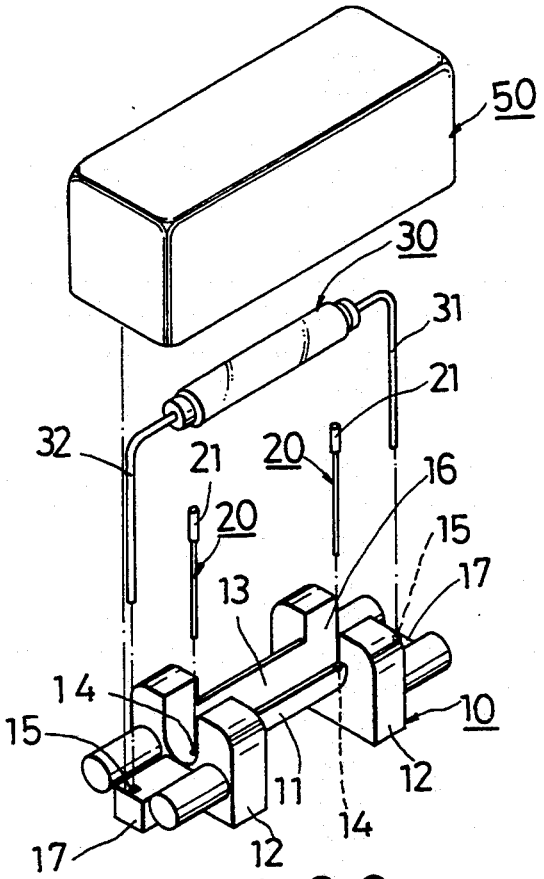
FIG. 3 is an exploded view showing a single-pole magnetic reed relay according to the preferred embodiment of this invention.
Figure 4:
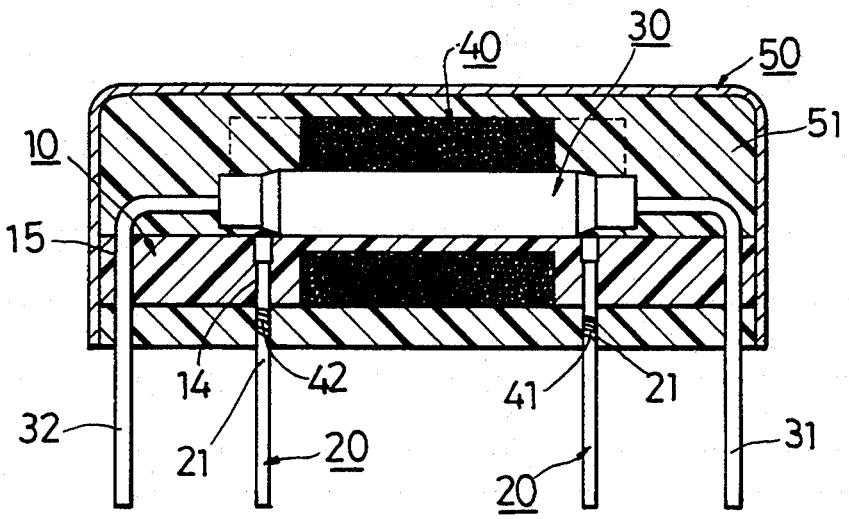
FIG. 4 is a sectional view illustrating the single-pole magnetic reed relay in accordance with the preferred embodiment of this invention.

Referring to FIGS. 3 and 4, the preferred embodiment of a single-pole magnetic reed relay of this invention includes a coil reel 10, two coil terminal 20, a reed contact unit 30, a coil 40 (see FIG. 4), and a case 50.

The coil reel 10, as shown in FIG. 3, includes an axially extending reel portion 11, two opposite stop ends 12, and two extension portions 17 formed outwardly of the stop ends 12. A reed receiving groove 13 extends axially in the reel portion 11 and the stop ends 12. A reed entrance 16 extends axially in the reel portion 11 and the stop ends 12 and is communicated with the reed receiving groove 13 in a radial direction. Two first holes 14 are formed respectively and radially through the stop ends 12. Two second holes 15 are formed respectively and radially through the extension portions 17. The first and second holes 14, 15 are aligned with one another and extend in the same diametrical direction as that of the reed entrance 16.

The coil terminals 20 extend respectively through the first holes 14 of the coil reel 10 and have head portions 21 positioned within the first holes 14 (see FIG. 4).

The reed contact unit 30, which is a substantially U-shaped body similar in construction to that of the conventional single-pole magnetic reed relay, is received in the reed receiving groove 13 of the coil reel 10 via the reed entrance 16 and has two conducting end portions 31, 32 which extend respectively from two end portions of the insulated tube of the reed contact unit 30 through the second holes 15 of the coil reel 10, as shown in FIG. 4. The distal ends of the coil terminals 20 and the conducting end portion 31, 32 of the reed contact unit 30 are trimmed so as to have equal lengths.

The coil 40 is wound around the reel portion 11 (see FIG. 3) of the coil reel 10 and the insulated tube of the reed contact unit 30, and has two distal ends 41, 42 connected respectively and directly to the head portions 21 of the coil terminals 20. Accordingly, the coil terminals 20 are connected electrically and directly to the coil 40.

Figure 5:
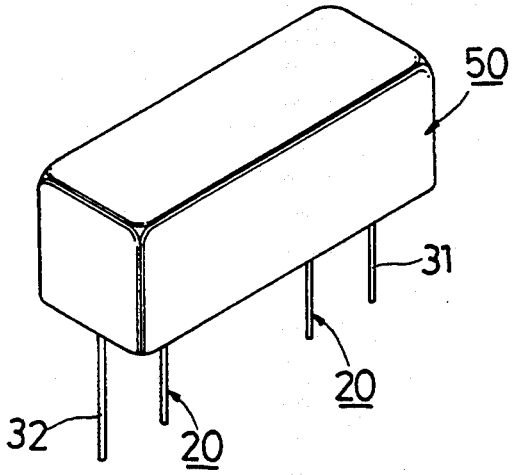
FIG. 5 is a perspective view showing the single-pole magnetic reed relay according to this invention.

The case 50 is used to contain the coil reel 10, the coil terminals 20, the reed contact unit 30 and the coil 40 therein while allowing only sections of the coil terminals 20 and the conducting end portions 31, 32 of the reed contact unit 30 to extend outwardly of the case 50. At this time, a resin 51 is provided in the case 50 to encapsulate the coil reel 10, the coil terminals 20, the reed contact unit 30 and the coil 40 in the case 50. In this way, the single-pole magnetic reed relay can be obtained, as shown in FIG. 5.

The advantages of the single-pole magnetic reed relay of this invention are as follows:

1. The printed circuit board and the transmission terminals of the conventional single-pole magnetic reed relay are not needed to construct the single-pole magnetic reed relay of this invention. The manufacturing materials for the single-pole magnetic reed relay of this invention can therefore be decreased.

2. Owing to the direct electrical connection between the coil 40 and the coil terminals 20, there is no need to test the single-pole magnetic reed relay of this invention after manufacture to verify the presence of electrical connection between the coil 40 and the coil terminals 20. In addition, when manufacturing the single-pole magnetic reed relay of this invention, the manufacturing step of cutting out the sections of the transmission terminals which extend outwardly of the case of the conventional single-pole magnetic reed relay can be eliminated.

3. Because of the fewer manufacturing materials and the simpler manufacturing steps involved, the manufacturing cost of the single-pole magnetic reed relay of this invention can be decreased.

With this invention thus explained, it is apparent that numerous modifications and variations can be made without departing from the scope and spirit of this invention. It is therefore intended that this invention be limited only as indicated in the appended claims.

I claim:

1. A single-pole magnetic reed relay comprising:

a coil reel including an axially extending reel portion, two opposite stop ends, a reed receiving groove extending axially in said reel portion and said stop ends, a reed entrance extending axially in said reel portion and said stop ends and communicated with said reed receiving groove in a radial direction, two extension portions formed outwardly of said stop ends, two first holes formed respectively and radially through said stop ends, and two second holes formed respectively and radially through said extension portions, said first and second holes being aligned axially with one another;

two coil terminals extending respectively through said first holes and having head portions positioned within said first holes;

a reed contact unit received in said reed receiving groove and having two conducting end portions which extend respectively through said second holes;

a coil wound around said reel portion and said reed contact unit and having two distal ends connected respectively and directly to said coil terminals;

a case for containing said coil reel, said coil terminals, said reed contact unit and said coil therein; and a resin provided in said case to encapsulate said coil reel, said coil terminals, said reed contact unit and said coil in said case.

2. A single-pole magnetic reed relay as claimed in claim 1, wherein said first and second holes extend in the same diametrical direction as that of said reed entrance.

* * * * *